United States Patent [19]

Steigerwald et al.

[11] 4,243,969

[45] Jan. 6, 1981

[54] LAYER RESISTOR ELEMENT

[75] Inventors: Wolf-Erhard Steigerwald; Heinz-Jürgen Siede; Bela Rösner, all of Bad Neustadt; Jürgen Zimmermann, Fuchsstadt, all of Fed. Rep. of Germany

[73] Assignee: PREH, Elektrofeinmechanische Werke Jakob Preh Nachf. GmbH & Co., Bad Neustadt, Fed. Rep. of Germany

[21] Appl. No.: 30,801

[22] Filed: Apr. 17, 1979

[30] Foreign Application Priority Data

Apr. 18, 1978 [DE] Fed. Rep. of Germany ..... 2816665

[51] Int. Cl.[3] ..... H01C 1/012

[52] U.S. Cl. ..... 338/309; 338/176; 338/314; 338/320

[58] Field of Search ..... 338/307–309, 338/89–91, 128, 138, 139, 160, 161, 176, 180, 181, 314, 195, 260, 320, 333, 334; 29/620

[56] References Cited

U.S. PATENT DOCUMENTS

| | | | |
|---|---|---|---|
| 3,601,744 | 8/1971 | Zandman | 338/308 |
| 3,723,938 | 3/1973 | Gramm | 338/176 X |
| 3,851,293 | 11/1974 | Clayton | 338/195 |
| 3,889,223 | 6/1975 | Sella et al. | 29/620 X |
| 3,896,284 | 7/1975 | Holmes | 338/308 X |
| 4,012,710 | 3/1977 | Ward et al. | 338/128 X |
| 4,100,525 | 7/1978 | Denes | 29/620 X |
| 4,123,741 | 10/1978 | Kiyono et al. | 338/138 X |
| 4,123,742 | 10/1978 | Nakamura et al. | 338/138 X |

FOREIGN PATENT DOCUMENTS

| | | |
|---|---|---|
| 1540265 | 1/1970 | Fed. Rep. of Germany . |
| 1950771 | 4/1970 | Fed. Rep. of Germany . |

OTHER PUBLICATIONS

"Laserstrahl-Trimmsystem für Hybridsohaltungen", Elektronik-Industrie, Issue No. ½, pp. 14, 15, 1974.

G. W. A. Dummer, "Variable Resisters and Potentiometers", *Radio and Electronic Components*, vol. 2, pp. 197 and 198, 1963.

*Primary Examiner*—C. L. Albritton

*Attorney, Agent, or Firm*—Schwartz, Jeffery, Schwaab, Mack, Blumenthal & Koch

[57] ABSTRACT

A layer resistor element for use in a variable resistor has two resistance layers disposed upon each other on an insulating substrate, the lower resistance layer being provided with two comb-like sets of separating slots extending from opposite sides to form a meander-like resistance path, the widths and lengths of the meander turns varying in accordance with a given non-linear resistance characteristic. The upper resistance layer which is of a material of higher resistivity than the lower resistance layer covers the lower layer partly or totally and extends beyond the lower layer at one side thereof where it provides a path for a slider of the variable resistor.

11 Claims, 6 Drawing Figures

Fig.1
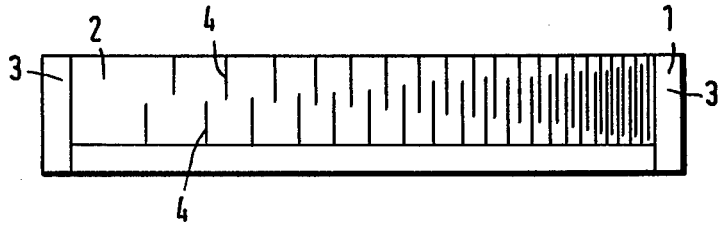
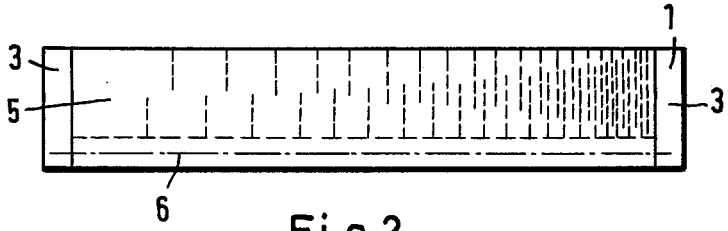
Fig.2
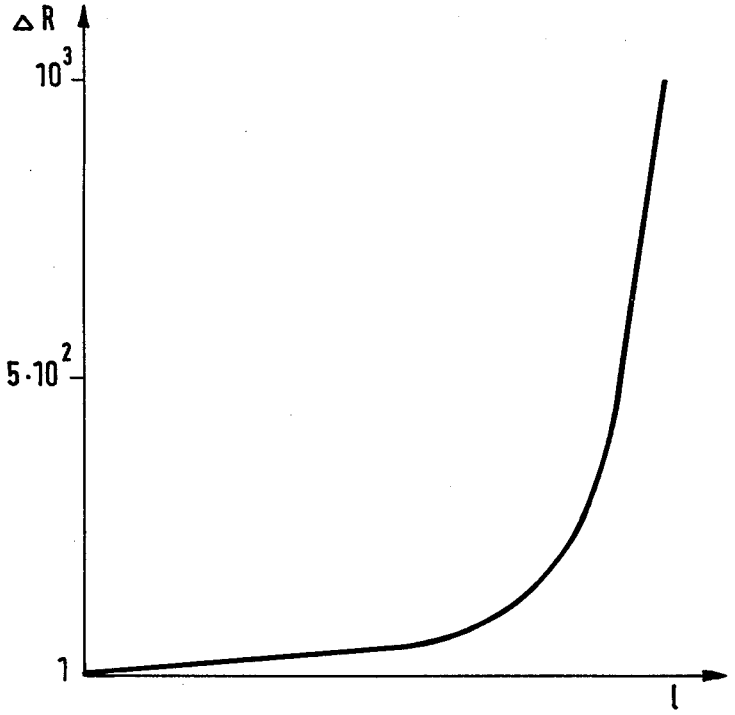
Fig.3

Fig.4
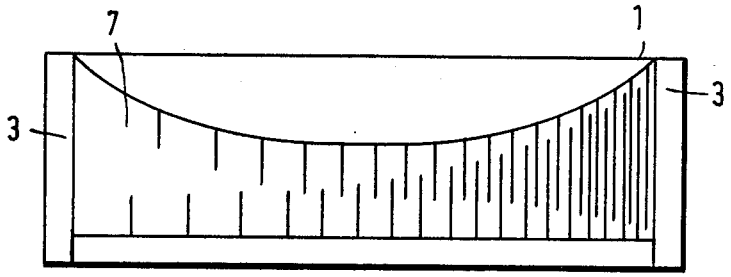
Fig.5
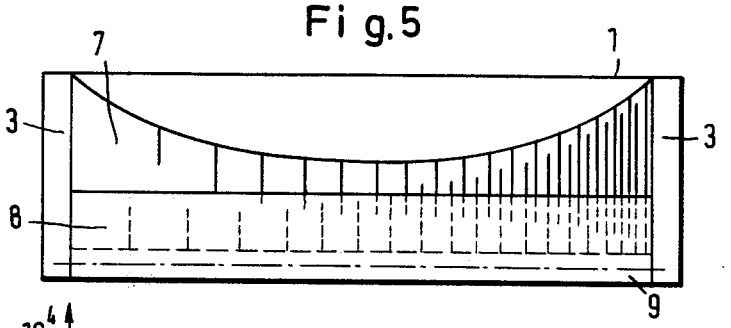
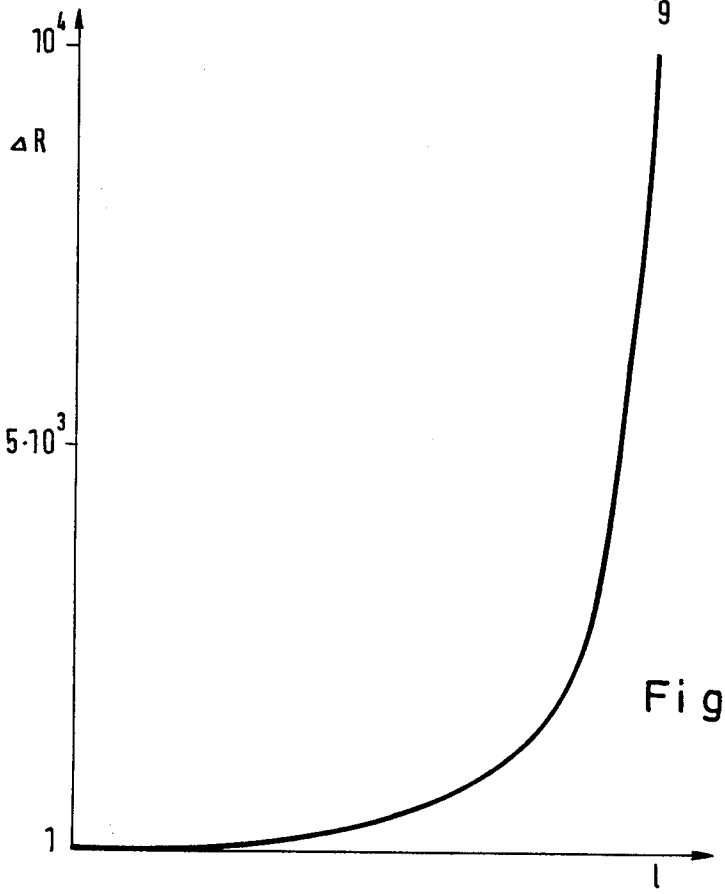
Fig.6

LAYER RESISTOR ELEMENT

BACKGROUND OF THE INVENTION

Layer resistor elements having a non-linear resistance characteristic are widely used in electroacoustics as well as in the field of measurement, control and communication engineering. As a further application, layer resistor elements of this type are used as voltage dividers for tuning RF circuits by adjusting the reverse voltage of tuning diodes contained in such RF circuits.

DESCRIPTION OF THE PRIOR ART

For manufacturing layer resistor elements having non-linear characteristics, it is known from German Offenlegungsschrift No. 15 40 265 to deposit layers of high conductivity, preferably silver layers, at opposite edges of a rectangular insulating plate, and between these layers resistance portions, the width of the resistance portions perpendicular to the travelling direction of a wiper increasing or decreasing in accordance with a predetermined function. This function may additionally be controlled by forming the potential distribution at the lead-in or lead-out contact surfaces in a particular manner.

German patent specification No. 1 950 771 discloses a method of adjusting a resistor element which includes a resistance layer disposed on an insulating substrate between two terminal electrodes. The terminal electrodes are so disposed that two current paths of different lengths are formed within the resistance layer. For the adjustment, slots are formed perpendicularly to the longitudinal sides of the resistance layer, one slot for coarse adjustment being provided in the area of the shorter current path and another slot for fine adjustment being provided in the area of the longer current path. This provides for greater accuracy in adjusting the total resistance.

It is known from German journal "Elektronik-Industrie", 1974, issue No. 1/2, pages 14 and 15, to manufacture such adjusting slots by means of computer controlled laser beam trimming systems. This process is applied particularly for adjusting fixed resistances in hybrid circuits in thick-film or thin-film technology. In simple cases where a nominal value is to be achieved with a tolerance of ±5%, one single adjusting slot extending from one of the longitudinal sides will suffice. For closer tolerances up to ±0.5%, a so-called L-cut is made. The adjusting slot extending transversely of the resistance path is used for the coarse adjustment, while the adjusting slot extension extending perpendicularly thereto along the direction of the resistance path serves for the fine adjustment. As a modification of the fine adjustment, a double-slot or meander cut is applied by which stepwise increasing maximum resistance values are achieved on a small area. Since this publication deals with fixed resistances, the adjusting slots of the last-mentioned modification have equal depths, lengths and spacings.

U.S. patent specification No. 4 123 742 describes a variable resistor including an insulating substrate and a resistance path formed in a back and forth winding pattern with constant width and pitch. A slider moves along the resistance path and has a plurality of contact tongues with at least one of the contact tongues always contacting the resistance path. A merely linear output voltage may thus be derived. The slider has a width which is no greater than that of the resistance path. In a modification, the width of the resistance path varies from one end to its other end either continuously or in a stepwise manner. In this case, the slider has a width that is greater than the maximum width of any winding of the resistance path. For achieving a greater resistance variation, a rectangular or triangular resistance portion is connected to the zig-zag resistance path. If a thin gold film is used for the resistance path, resistance variations of several hundred ohms up to several kilohms may be achieved on a relatively small-size substrate. The ratio of maximum to minimum resistance value to be achieved, related to a predetermined adjusting length unit, is thus 25 at the best. There are applications, however, in which this ratio is still too small.

A further variable resistor is known from U.S. Pat. No. 4,123,741 in which a zig-zag resistance element formed by a resistance wire is mounted on an insulating substrate. A contact spring slides on a resistance film consisting of a carbon-resin-combination provided on the resistance wire. The amplitude and the number per unit length of the zig-zag turns of the resistance wire may vary. In a modification, an additional resistance for the fine adjustment is provided. The film has the purpose to avoid discontinuities in the resistance characteristic. Since the resistance of the film is greater than that of the wire, a certain smoothening is achieved. It is not possible, however, to obtain a characteristic having no noticeable transitions, particularly when a contact spring having one tapping point is employed as usual. On the other hand, the type of contact spring is not defined in this patent specification. Since resistance films may exist between the turns of the resistance wire, a maximum resistance variation per unit length of 25 may be achieved. Again, this value is too small for a resistor intended for universal application.

SUMMARY OF THE INVENTION

It is an object of the invention to provide a layer resistor element having a non-linear resistance characteristic and a high resistance variation per unit length.

It is a further object of the invention to provide a layer resistor element which avoids discontinuities in the resistance characteristic irrespective of the structural design of the wiper used on the resistance element.

As a further object of the invention, a layer resistor element having a non-linear characteristic is desired having a temperature coefficient as low as possible.

Still another object of the invention is to provide a layer resistor element having a non-linear resistance characteristic, which is easy to manufacture.

Briefly, the layer resistor element for use in a variable resistor having a non-linear resistance characteristic in accordance with the present invention comprises an insulating substrate, two terminal electrodes provided at opposite ends of the substrate, a first resistance layer disposed on the substrate in contact with the terminal electrodes, two comb-like sets of separating slots cut into the first resistance layer alternatingly from opposite sides thereof so as to mesh with each other, with the area of the slots being negligible relatively to the area of the first resistance layer, and the lengths and spacings of the slots of each set being defined in accordance with said non-linear characteristic, and a second resistance layer disposed on the first resistance layer so as to cover the same partly or completely and having a greater resistivity than the first layer, the second resistance layer extending beyond the first layer at a side thereof to form a slide way for a wiper of the variable resistor. Preferably, the sides of the first resistance layer extend parallel to each other or form concentric circles. The separating slots in the first resistance layer may be formed by laser or electron beams, by sand blasting, by mechanical scribing or by chemical etching.

BRIEF DESCRIPTION OF THE DRAWINGS

FIG. 1 shows a resistor element consisting of a substrate with a first resistance layer disposed thereon;

FIG. 2 shows the same resistor element as FIG. 1, but with the second resistance layer disposed upon the first resistance layer;

FIG. 3 is a graph showing the resistance characteristic of the element according to FIGS. 1 and 2;

FIG. 4 shows another resistor element, consisting of a substrate and a first resistance layer disposed thereon, wherein the shape of the first resistance layer differs from that of a rectangle;

FIG. 5 shows the same resistor element as FIG. 4, but with the second resistance layer deposited upon the first layer; and FIG. 6 is a graph showing the resistance characteristic of the element according to FIGS. 4 and 5.

DETAILED DESCRIPTION OF THE PREFERRED EMBODIMENTS

FIG. 1 shows an elongate substrate 1 consisting of insulating material such as cardboard or ceramics. A first resistance layer 2 having two parallel longitudinal sides and two ends is deposited on the substrate 1 by a conventional process. Terminal electrodes 3 of high conductivity are connected to the ends of the resistance layer 2. Separating slots 4 are cut in the resistance layer 2 from the two longitudinal sides. These slots may be provided simultaneously with the deposition of the resistance layer, e.g. by photolithography. Alternatively, the slots may be provided subsequently to the deposition of the resistance layer 2 on the substrate 1 by laser beams, sand blasting, electron beams, mechanical scribing or chemical etching. Irrespective of the method employed, the separating slots 4 must have an area negligible in comparison to the area of the resistance layer in order to achieve a great resistance variation per unit length of the layer 2.

The separating slots extend alternatingly from the two longitudinal sides so that they mesh with each other in a comb-like manner. For achieving a non-linear resistance characteristic, the lengths and spacings of the slot 4 vary. The envelope of the comb teeth, thus the lengths and spacings of the slots, may be determined by means of a computer in such a manner that a monotonously increasing or decreasing characteristic is obtained. In order to achieve desired resistance variations, the separating slots 4 must extend over one-half of the layer width. Resistance variations on the order of 1000 are thus achieved, and the resistor element formed in accordance with the invention may therefore be used for an essentially greater field of applications than resistor elements of the prior art described above.

In case a wiper were arranged to slide on the resistance layer 2 in FIG. 1, the resistance characteristic would have discontinuities at the locations of the slots 4. To avoid such disadvantage, a second resistance layer 5 is provided to cover the first resistance layer 2, the second layer 5 having a higher resistivity—preferably by one to several powers—than the first layer 2. Accordingly, the behaviour of the temperature coefficient of the entire resistor element merely corresponds to that of the first resistance layer 2. Since low-resistivity layers have lower temperature coefficients than high-resistivity layers, the temperature coefficient of the entire resistor element is advantageously affected.

Both resistance layers are made from a material containing electrically conductive particles in a binder. To simplify the production, it is desired to use the same binder but different amounts of electrically conductive particles for the low- and high-resistivity layers.

The second resistance layer 5 is applied such that it covers the first resistance layer 2 partly or totally. Furthermore, as shown in FIG. 2, the second resistance layer extends beyond one of the longitudinal sides of the first resistance layer 2 to form a lateral surface 6. A wiper (not shown) slides on this lateral surface 6, the path of the slider being indicated by a dash-and-dot line in FIG. 2.

As a result of the disposition of the second resistance layer 5 in accordance with FIG. 2, the resistance characteristic shown in the graph of FIG. 3 has no noticeable discontinuities.

In case a still greater resistance variation is required, the resistance element may be designed in accordance with FIGS. 4 and 5. As shown there, the first resistance layer 7 has a shape differing from that of a rectangle, at least at its two end portions. The resistance variation achieved in the embodiments of FIGS. 4 and 5 is thus greater by a factor 10 than that achieved with the resistance element of FIGS. 1 and 2.

According to FIG. 5, a second resistance layer 8 having a higher resistivity than the first resistance layer 7 is deposited on the first layer 7 so as to cover the same only in part. The second layer 8 is rectangular. It again extends beyond the first resistance layer 7 to form a lateral surface 9 to provide a sliding path for a wiper (not shown). Due to this feature, the size of the contact area provided by the wiper is uncritical.

The above described embodiments relate to straight resistor elements only. Annular resistor elements for rotary variable resistors are also within the scope of this invention.

We claim:

1. A layer resistor element for use in a variable resistor having a non-linear resistance characteristic, comprising (a) an insulating substrate, (b) two terminal electrodes provided at opposite ends of the substrate, (c) a first resistance layer disposed on the substrate in contact with said terminal electrodes, (d) two comb-like sets of separating slots cut into said first resistance layer alternatingly from opposite sides thereof so as to mesh with each other, the area of the slots being negligible relatively to the area of the first resistance layer, and the lengths and spacings of the slots of each set being defined in accordance with said non-linear characteristic, and (e) a second resistance layer disposed on the first resistance layer and having a greater resistivity than the first resistance layer, the second resistance layer extending beyond the first resistance layer at a side thereof to form a slide way for a wiper of said variable resistor.

2. The resistor element of claim 1, wherein said characteristic is monotonously increasing or decreasing.

3. The resistor element of claim 1, wherein said separating slots extend over at least one-half of the width of said first resistance layer.

4. The resistor element of claim 1, wherein said second resistance layer covers said first resistance layer only in part.

5. The resistor element of claim 1, wherein said separating slots are formed by laser beams.

6. The resistor element of claim 1, wherein said separating slots are formed by sand blasting.

7. The resistor element of claim 1, wherein said separating slots are formed by electron beams.

8. The resistor element of claim 1, wherein said separating slots are formed by mechanical scribing.

9. The resistor element of claim 1, wherein said separating slots are formed by chemical etching.

10. The resistor element of claim 1, wherein the sides of said first resistance layer extend parallel to each other.

11. A layer resistor element for use in a variable resistor having a non-linear resistance characteristic, comprising (a) an insulating substrate, (b) two terminal electrodes provided at opposite ends of the substrate, (c) a first resistance layer disposed on the substrate in contact with said terminal electrodes, said first resistance layer having a shape differing from that of a rectangle, (d) two comb-like sets of separating slots cut into said first resistance layer alternatingly from opposite sides thereof so as to mesh with each other, the area of the slots being negligible relatively to the area of the first resistance layer, and the lengths and spacings of the slots of each set being defined in accordance with said non-linear characteristic, and (e) a second resistance layer disposed on the first resistance layer and having a greater resistivity than the first resistance layer, the second resistance layer extending beyond the first resistance layer at a side threof to form a slide way for a wiper of said variable resistor.

* * * * *